US005523767A

United States Patent [19]

McCorkle

[11] Patent Number: 5,523,767

[45] Date of Patent: Jun. 4, 1996

[54] WIDEBAND DUAL-POLARIZED TILTED DIPOLE ANTENNA

[75] Inventor: John W. McCorkle, Laurel, Md.

[73] Assignee: The United States of America as represented by the Secretary of the Army, Washington, D.C.

[21] Appl. No.: 18,592

[22] Filed: Feb. 17, 1993

[51] Int. Cl.[6] ..... H01Q 21/00

[52] U.S. Cl. ..... 343/810; 343/816; 343/846

[58] Field of Search ..... 343/810, 811, 343/812, 813, 814, 816, 820, 829, 830, 846, 848; H01Q 21/00

[56] References Cited

U.S. PATENT DOCUMENTS

| | | | |
|---|---|---|---|
| 2,175,252 | 10/1939 | Carter | 250/33 |
| 2,486,589 | 11/1949 | Chu | 250/33 |
| 2,630,530 | 3/1953 | Adcock et al. | 343/848 |
| 3,488,657 | 1/1970 | Pressel et al. | 343/848 |
| 3,562,755 | 7/1968 | Bonadio | 343/814 |
| 3,691,561 | 9/1972 | Jager | 343/808 |
| 3,725,943 | 4/1973 | Spanos | 343/846 |
| 4,608,572 | 8/1986 | Blakney et al. | 343/846 |

FOREIGN PATENT DOCUMENTS

| | | | |
|---|---|---|---|
| 1344584 | 10/1963 | France | 343/810 |

*Primary Examiner*—Hoanganh Le

*Attorney, Agent, or Firm*—Freda L. Krosnick; Frank J. Dynda

[57] ABSTRACT

A fully polarimetric broadband antenna for emitting and receiving non-dispersive EMP signals has dipole elements orthogonally mounted on a ground plane which tilts the elements relative to the direction of wave propagation. The ground plane can be shaped into either a pyramid or cone, and the elements may be truncated cones or substantially discus-shaped. A single-pole-single-throw reed relay is mounted between dipole elements which are independently driven to provide horizontal and vertical polarizations. The antenna provides a response and pattern suitable for transmitting short EMP signals useful in radar and communications applications.

12 Claims, 3 Drawing Sheets

WIDEBAND DUAL-POLARIZED TILTED DIPOLE ANTENNA

GOVERNMENTAL INTEREST

The invention describe herein may be manufactured, used and licensed by or for the U.S. Government for governmental purposes without the payment to me of any royalties thereon.

BACKGROUND OF THE INVENTION

1. Field of the Invention

The present invention relates generally to wideband dual-polarized antennas having horizontal and vertical elements which are suitable for transmitting and receiving short electromagnetic pulse (EMP) signals, and more particularly, to a dual-polarized antenna having a ground plane that separates dipole elements from one another and tilts the radiating elements.

2. Description of the Prior Art

It is well known that an antenna acts as a transformer between free space and a transmitter or receiver. It is also known that the efficiency of transformation depends in part on how well an antenna is matched to the feed line which connects the antenna to a transmitter or receiver. Matching the impedance of an antenna to a feed line typically involves an understanding of signal characteristics and the particular antenna employed, both of which are dictated by the specific application. Considerations of bandwidth, dispersion, polarization, and physical size may or may not be important depending on the intended application.

Common types of antenna include the biconical dipole, the monopole discone, spirals and helicals, the single and crossed Yagi-Uda, the TEM horn, and the familiar log-periodic antenna. The characteristics of the electromagnetic signal which is broadcasted or detected determines which of these antennas is suitable for a given application. For example, an antenna for use in a pulse radar unit must be able to transmit and receive short electromagnetic pulse (EMP) signals. Since EMP signals are composed of all frequencies, a radar antenna must have a wide frequency response. Antennas having a wide frequency response are commonly referred to as being wideband or broadband antennas. For purposes of consistency, we regard all antennas having a bandwidth greater than about 90% as being broadband, where $$\text{Bandwidth} = 100\left(\frac{\Delta f}{f_0}\right)$$

$\Delta f$ being the frequency difference between half-power points, and $f_0$ the center frequency of the antenna. By this criteria the biconical dipole, monopole discone, spiral, helical, TEM horn, and log-periodic type antennas are all broadband.

In addition to being broadband, it is also desirable for a radar antenna to be fully polarimetric. A fully polarimetric antenna is capable of transmitting and receiving vertically and horizontally (i.e. orthogonally) polarized electromagnetic waves simultaneously. Thus, fully polarimetric antennas are sometimes referred to as being dual-polarized. Polarization is an important consideration in radar since it is difficult to predict a priori whether an unseen target presents a primarily vertical or horizontal profile. While single feed Yagi-Uda and log-periodic antennas are linearly polarized, crossed Yagi-Uda and log-periodic antennas have twin feeds and are fully polarimetric. However, neither the single feed nor the crossed Yagi-Uda antennas is broadband. Helical, spiral, biconical, and discone antennas have heretofore been either linearly or circularly polarized, making them less than ideal choices for a radar antenna.

It is also desirable for a radar antenna, and indeed any EMP antenna, to be non-dispersive. Dispersion, also known as group delay, concerns the speed of electromagnetic radiation and its variation with frequency. A non-dispersive antenna transmits all frequencies in such a way that they travel together. Thus, a short pulse fed into a non-dispersive antenna will retain its step-like characteristic when received by another non-dispersive antenna. Dispersive antennas, on the other hand, can decrease the rise time of a signal thereby "softening" a step pulse input into a rounded chirp transmission. Sharp pulses are preferred in radar and communications since they are more easily discerned and analyzed. Only the TEM horn, biconical dipole and monopole discone antennas are non-dispersive, and none of these is fully polarimetric.

SUMMARY OF THE INVENTION

Accordingly, it is an object of the present invention to provide a broadband antenna suitable for transmitting and receiving EMP signals.

It is another object of the present invention to provide a fully polarimetric antenna for transmitting and receiving EMP signals.

It is still another object of the present invention to provide a broadband, fully polarimetric and non-dispersive antenna for transmitting and receiving EMP signals.

It is yet another object of the present invention to provide a fully polarimetric biconical dipole antenna.

These objects and others not specifically enumerated are accomplished by providing an antenna that comprises a plurality of dipoles orthogonally mounted on a conical or pyramidal ground plane which separates the individual elements of the dipoles and tilts them at a specified angle. A semiconductor single-pole-single-throw (SPST) switch connected between dipole feed points and a pair of high voltage power supplies provide the transmitting pulse. the antenna elements are charged through two high voltage power supplies to +V and −V. The charge and antenna result in energy being stored in a quasistatic field around the antenna. The antenna is then discharged quickly (on the order of a few picoseconds) through the semiconductor (SPST) switch resulting in the propagation of a short electromagnetic pulse. Either a positive-going or a negative-going pulse can be broadcasted. The antenna has two orthogonal polarizations, typically horizontal and vertical. The antenna elements are essentially broadband dipoles and can be truncated conical elements or substantially discus-shaped elements.

BRIEF DESCRIPTION OF THE DRAWINGS

The preferred embodiments of the present invention will be described with reference to the accompanying drawings in which.

DESCRIPTION OF THE PREFERRED EMBODIMENTS

Figure 1A:
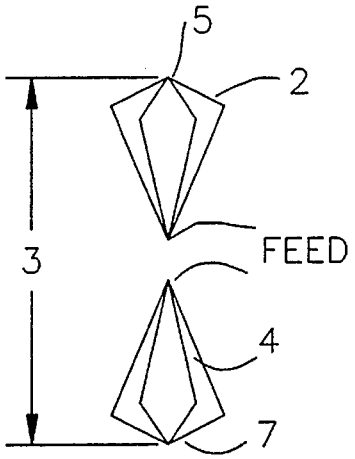
FIG. 1A PRIOR ART
FIG. 1*a* shows a side view of a prior art vertically polarized truncated biconical dipole antenna configuration.

Referring now to the drawings, like reference numerals represent identical or corresponding parts throughout the several views.

Figure 1B:
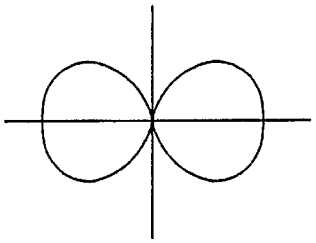
FIG. 1B PRIOR ART
FIG. 1*b* shows the radiation pattern associated with the vertically polarized truncated biconical dipole antenna configuration of FIG. 1*a;*
Figure 2A:
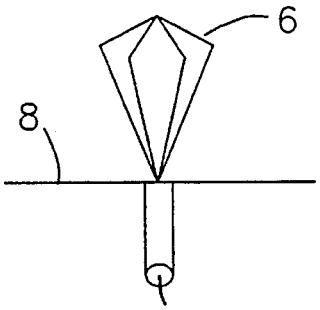
FIG. 2A PRIOR ART
FIG. 2*a* shows a side view of a prior art vertically polarized truncated monopole cone (discone) mounted on a ground plane.

FIG. 1*a* shows a prior art vertically polarized biconical dipole antenna, having truncated conical elements 2 and 4, arranged along a common axis, apex adjacent to apex, with its associated radiation pattern as shown in FIG. 1*b*. These "truncated" conical elements appear as two separate right circular conical sections stacked base to base one atop the other. The term truncated, as used in this specification, is not to be confused with a geometrically truncated cone in which a cut not parallel to the base is made. FIG. 2*a* shows a prior art vertically polarized truncated monopole cone 6 mounted on ground plane 8 with its associated radiation pattern shown in FIG. 2*a*. The ground plane 8 causes the main beam 10 to be raised above the ground plane 8 at an angle 16 approximately equal to 15°.

Figure 3A:
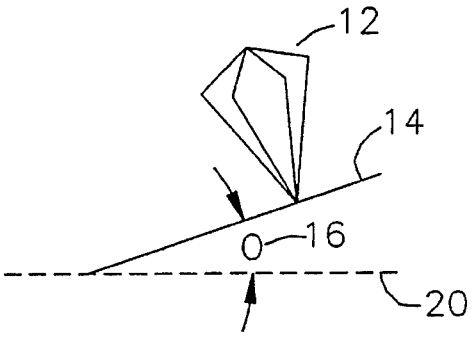
FIG. 3*a* shows a side view of a vertically polarized truncated monopole cone mounted on a tilted ground plane.
Figure 3B:
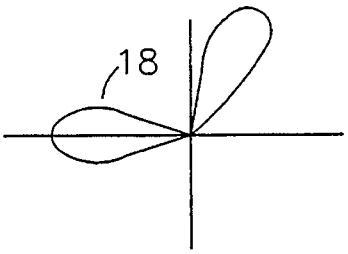
FIG. 3*b* shows the radiation pattern associated with the vertically polarized truncated monopole cone on a tilted ground plane as shown in FIG. 3*a;*
Figure 4A:
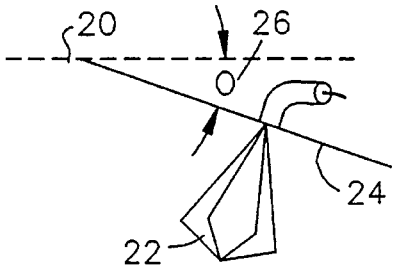
FIG. 4*a* shows a side view of a vertically polarized upside down truncated monopole cone mounted on a tilted ground plane.
Figure 4B:
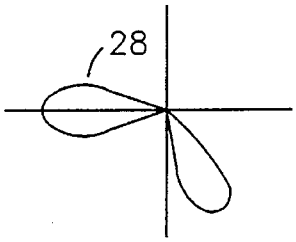
FIG. 4*b* shows the radiation pattern associated with the vertically polarized upside down truncated monopole cone on a tilted ground plane as shown in FIG. 4*a;*
Figure 5A:
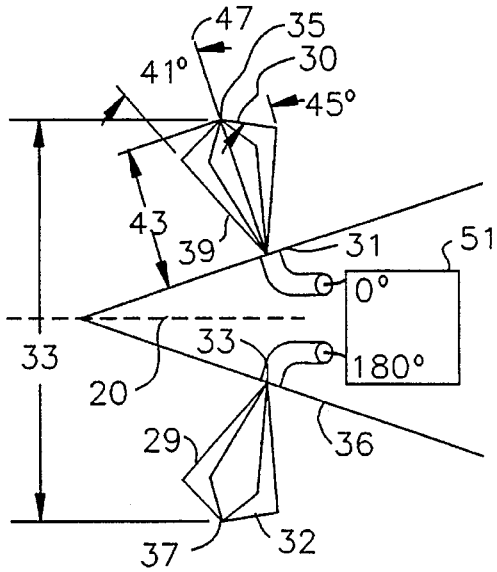
FIG. 5*a* shows a side view of a vertically polarized truncated biconical antenna with conical elements separated by tilted ground planes.
Figure 5B:
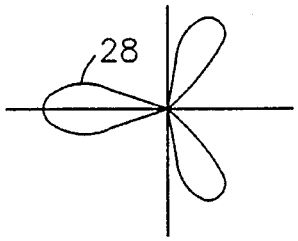
FIG. 5*b* shows the radiation pattern associated with the vertically polarized truncated biconical dipole antenna as shown in FIG. 5*a;*

FIGS. 3–5 show a progression of configurations from a center fed titled truncated cone, FIG. 3*a,* to biconical elements separated by a pair of tilted ground planes, FIG. 5. FIG. 3*a* shows a truncated conical element 12 mounted on a tilted ground plane 14. the angle of tilt 16 is chosen so that the radiation pattern 18 of the conical element 12, as shown in FIG. 3*b,* is preferably directed forward along the horizontal 20. FIG. 4*a* shows an "upside down" truncated conical element 22 mounted on a tilted ground plane 24. The angle of tilt 26 is chosen so that, like the conical element 12, the radiation pattern 28 of conical element 22 is directed forward along the horizontal 20. FIG. 5 shows a truncated biconical dipole arrangement that combines the features shown in FIGS. 3*a* and 4*a*. The truncated biconical dipole in FIG. 5*a* shows conical elements 30 and 32 separated from one another by tilted ground planes 34 and 36 respectively. The conical elements 30 and 32 are mounted on the ground planes 34 and 36 in a symmetrical manner such that the apex of each element is directed toward a point 38 along the axis of symmetry (in this case the horizontal axis) 20. The antenna pattern resulting from the configuration in FIG. 5*a* is shown in FIG. 5*b* in which the main lobe 40 of the radiation pattern is directed in a preferred forward direction along the horizontal 20. Separation of conical elements 30 and 32 creates enough space between tilted ground planes 34 and 36 to allow placement of a switch between the feed ends 31 and 33 and/or co-location of a second set of conical elements (see FIGS. 7 and 8) which radiate in a plane orthogonal to that of the first pair of elements 30 and 32, rendering the antenna fully polarimetric. Heretofore, high frequency (100–2000 MHz) biconical dipole antennas have been difficult to feed with coaxial cable due to the small size of the elements and the narrow gap between adjacent feed ends. The present invention, however, allows placement of one or more switches and a second pair of radiating elements at one location, thereby achieving dual-polarity and eliminating dispersion problems which can be caused by spatial offsets.

Figure 6:
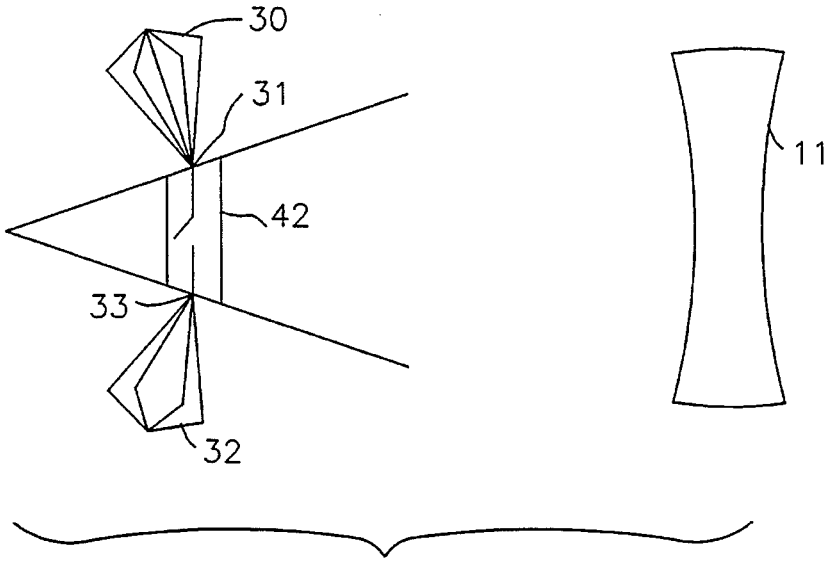
FIG. 6 shows a side view of a truncated biconical dipole antenna with truncated conical elements separated by tilted ground planes and having a reed relay coaxially mounted therebetween.

FIG. 6 shows a single-pole-single-throw reed relay switch 42 coaxially mounted between the feed ends 31 and 33 of conical elements 30 and 32 respectively. The HG1 or HGW mercury reed switches produced by Clare of Chicago, Ill., has proven successful in applications such as these. FIG. 6 also shows an RF absorber 11 placed "behind" the antenna to attenuate the lobes projecting to the rear of the antenna. Suitable RF absorbing materials for this purpose are ECCOSORB® AN-79, produced by Emerson & Cumming of Kent, Mass., or C-RAM® LF-79, produced by Cumming Corp. of Avon, Mass., both of which are available in three-inch-thick sheets.

Figure 7:
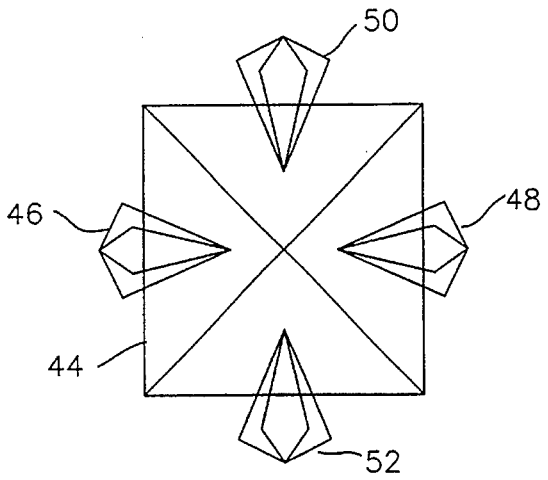
FIG. 7 shows a front view of an aspect of the present invention in which a plurality of truncated biconical dipoles are orthogonally mounted on a pyramidal ground plane.

FIG. 7 shows the construction of an aspect of the present antenna in which the vertically polarized biconical dipoles discussed in FIGS. 5 and 6 are combined with a similarly constructed horizontally polarized biconical dipole. The resultant antenna has a pyramidal ground plate 44 upon which a first truncated biconical dipole comprised of conical elements 46 and 48 is orthogonally mounted on the ground plane 44 with respect to a second truncated biconical dipole comprised of conical elements 50 and 52. The view shown in FIG. 7 is looking directly into the front of the antenna. Reed relay switches, not shown, can be mounted between the conical elements of each biconical dipole.

Figure 8:
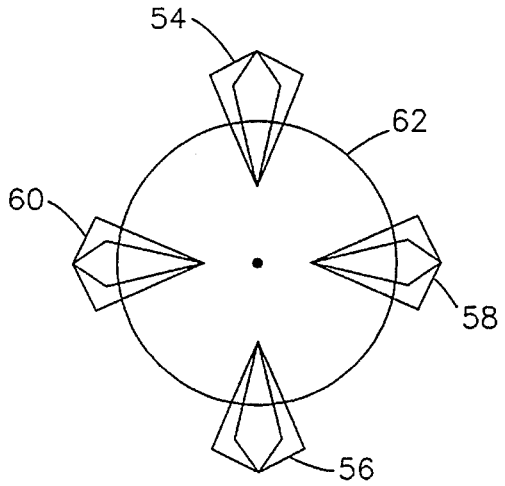
FIG. 8 shows a front view of an aspect of the present invention in which a plurality of truncated biconical dipoles are orthogonally mounted on a conical ground plane.

FIG. 8 shows an aspect of the present invention in which a plurality of truncated biconical dipoles comprised of conical elements 54 and 56 for a first dipole and 58 and 60 for a second dipole are orthogonally mounted with respect to each other on a conical ground plane 62. The view shown in FIG. 8 is looking directly in the front of the antenna. Again, reed relay switches, not shown, are mounted between conical elements of each biconical dipole.

In prior art biconical dipole antennas, as shown in FIG. 1*a,* the dominant feature for determining low frequency response is the tip-to-tip dimension 3 of the bicone's dipole elements which extends from the top 5 of conical element 2 to the top 7 of conical element 4. Similarly, as shown in FIG. 5*a,* the dominant feature for determining low frequency response of the present antenna is the tip-to-tip dimension 33 of the bicone's dipole elements which extends from the top 35 of conical element 30 to the top 37 of conical element 32. For determining the high frequency response of the present antenna, the front edge 39 of conical element 30 in conjunction with the ground plane 34 form an expanding transmission line that can transmit an electromagnetic wave along a preferred direction. Similarly, the front edge 29 of conical element 32 in conjunction with the ground plane 36 also form an expanding transmission line.

While the truncated cortical elements can be made by shaping a plurality of stiff wires as shown in FIGS. 1 through 8, the truncated conical elements can also be made of solid or hollow conductors. Eight wires equiangularly spaced have typically been used to shape the conical elements. Referring back to FIG. 5*a*, the truncated conical elements 30 and 32 can also be made so that wire thickness, and thus resistance, varies along the length of each element. Such a characteristic is useful in damping resonant oscillations of the radiating elements, thereby preventing the phenomena known as "ringing." The preferred resistive taper involves the tops 35 and 37 of conical elements 30 and 32 being highly resistive (i.e. exhibiting a relatively small diameter) and the throats (near feed points 31 and 33) being highly conductive. If elements 30 and 32 comprise hollow biconical surfaces rather than a collection of conductive wires, it is possible to create a resistive taper by varying the wall thickness of the biconical surface.

Figure 2B:
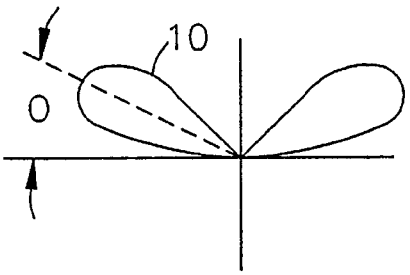
FIG. 2B PRIOR ART
FIG. 2*b* shows the radiation pattern associated the vertically polarized truncated monopole cone of FIG. 2*a;*

The antenna cone half-angle 41, the height of the cone 43, and the angle 45 at which the truncated section fold back to the center axis 47 of the cone are appropriately chosen for the frequency response desired using well known design criteria for biconical dipole antennas. In particular, the choice of half-angle 41 is driven by the need to maximize efficiency by matching the feed-line impedance, $Z_0$. The relation between the two is commonly expressed as:

$$Z_0 = 120\ln\left(\cos\frac{\theta_h}{2}\right)$$

where $\theta_h$ denotes the half-angle 41 and $Z_0$ is measured in Ohms. Feed-line impedance usually ranges from 50 to 400 Ω for a typical coaxial cable connection. It should be noted that the present invention makes possible the construction of a fully polarimetric biconical antenna having a low surge impedance, even though low impedance connections normally require a large half-angle 41 and thus, larger elements. The tilted ground plane separates orthogonally polarized elements so that they can be co-located without physical obstruction. Interestingly, the angle of propagation θ shown in FIG. 2*b* is independent of half-angle 41 to the first order, and is generally about 15°. Thus, the angle of tilt 16 and 26 as illustrated in FIGS. 3*a* and 4*a* is preferably chosen as 15°. The height of the cone 43 is typically set at half a wavelength.

Figure 9:
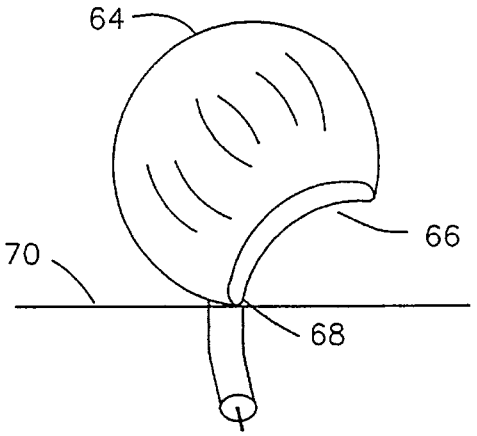
FIG. 9 shows a side view of a substantially discus-shaped monopole element mounted on a ground plane.

FIG. 9 illustrates another embodiment of the present invention in which the shape of the dipole's radiation elements can be modified to provide different width and depth dimension for enhancing directivity, reducing geometric profile, and for increasing equivalent capacitance. The leading edge of the radiating elements is derived from theoretical curves described by Dr. Carl Baum in a paper entitled "An Equivalent-Charge Method for Defining Geometries of Dipole Antennas," Note 72, EMP 1–5, Air Force Weapons Laboratory (1969). The entire element most closely resembles a substantially discus shaped conductor 64 having a substantially elliptical cut-out 66 near the feed point 68 which reduces the backward-directed high frequency radiation between the ground plane 70 and the discus at the cut-out 64. These discus shaped elements are likewise orthogonally mounted on a ground plane as discussed above.

While there has been described and illustrated specific embodiments of the invention, it will be obvious that various changes, modifications and additions can be made herein without departing from the field of the invention which should be limited only by the scope of the appended claims.

I claim:

1. A fully polarimetric, non-dispersive, broadband antenna comprising a plurality of dipoles, wherein each dipole comprises independently driven conductor elements; and ground plane means comprising at least one inclined surface disposed symmetrically about a central axis in a conical fashion; wherein said independently driven conductor elements are mounted upon said at least one inclined surface and in at least two orthogonal plates which contain the central axis of said ground plane means wherein said ground plane means comprises a conical surface and said independently driven conductor elements are orthogonal to said surface and tilted toward a common point on the central axis of said ground plane means.

2. The antenna of claim 1 wherein said ground plane means comprises a pyramidal surface and each independently driven conductor element is orthogonal to a side of said pyramidal surface and tilted toward a common point on the central axis of said ground plane means.

3. The antenna of claim 1 or 2 wherein each of said independently driven conductor elements comprises a plurality of wires in a substantially conical formation.

4. The antenna of claim 1 or 2 wherein each of said independently driven conductor elements comprises a continuous and substantially conical surface.

5. The antenna of claim 1 or 2 wherein each of said independently driven conductor elements comprises a continuous and substantially conical surface having a wall thickness which varies along its length to create a resistive taper.

6. The antenna of claim 1 or 2 wherein each of said independently driven conductor elements comprises a substantially discus shaped surface provided with a substantially semielliptical cut-out adjacent to the surface of said ground plane means.

7. A fully polarimetric, non-dispersive, broadband antenna comprising;

a plurality of dipoles, wherein each dipole comprises independently driven conductor elements;

ground plane means comprising at least one inclined surface disposed symmetrically about a central axis in a pyramidal fashion, wherein said independently driven conductor elements are mounted upon said at least one inclined surface and in at least two orthogonal planes which contain the central axis of of said ground plane means;

a plurality of coaxial feed-lines, each comprising an inner and an outer conductor, wherein said inner conductor extends from one of said independently driven conductor elements and said outer conductor is attached to said ground plane means in the vicinity of said one of said independently driven conductor elements;

and switching means disposed within the region bounded by said at least one inclined surface and attached to said plurality of coaxial feed-lines;

whereby closure of said switching means causes short electromagnetic pulse signals having at least two different polarizations to be transmitted by the antenna, and wherein said ground plane means comprises a conical surface and said independently driven conductor elements are orthogonal to said surface and tilted toward a common point on the central axis of said ground plane means.

8. The antenna of claim 7 wherein said ground plane means comprises a pyramidal surface and each independently driven conductor element is orthogonal to a side of said pyramidal surface and tilted toward a common point on the central axis of said ground plane means.

9. The antenna of claim 7 or 8 wherein each of said independently driven conductor elements comprises a plurality of wires in a substantially conical formation.

10. The antenna of claim 7 or 8 wherein each of said independently driven conductor elements comprises a continuous and substantially conical surface.

11. The antenna of claim 7 or 8 wherein each of said independently driven conductor elements comprises a continuous and substantially conical surface having a wall thickness which varies along its length to create a resistive taper.

12. The antenna of claim 7 or 8 wherein each of said independently driven conductor elements comprises a substantially ,discus shaped surface provided with a substantially semielliptical cut-out adjacent to the surface of said ground plane means.

* * * * *